US009071385B2

(12) United States Patent
Delaveau et al.

(10) Patent No.: US 9,071,385 B2
(45) Date of Patent: Jun. 30, 2015

(54) METHOD FOR JAMMING COMMUNICATIONS IN A CLOSED-LOOP CONTROL NETWORK

(71) Applicant: Thales, Neuilly-sur-Seine (FR)

(72) Inventors: François Delaveau, Gennevilliers (FR); Dominique Heurgier, Gennevilliers (FR); Bertrand Gerfault, Gennevilliers (FR)

(73) Assignee: THALES, Courbevoie (FR)

( * ) Notice: Subject to any disclaimer, the term of this patent is extended or adjusted under 35 U.S.C. 154(b) by 414 days.

(21) Appl. No.: 13/684,453

(22) Filed: Nov. 23, 2012

(65) Prior Publication Data

US 2013/0178148 A1 Jul. 11, 2013

(30) Foreign Application Priority Data

Nov. 24, 2011 (FR) ..... 11 03578

(51) Int. Cl.
*H04K 3/00* (2006.01)

(52) U.S. Cl.
CPC .. *H04K 3/00* (2013.01); *H04K 3/28* (2013.01); *H04K 3/43* (2013.10); *H04K 3/94* (2013.01); *H04K 2203/34* (2013.01); *H04K 2203/36* (2013.01)

(58) Field of Classification Search
CPC . H04K 2203/34; H04K 2203/36; H04K 3/00; H04K 3/28; H04K 3/43; H04K 3/94
USPC ..... 455/1
See application file for complete search history.

(56) References Cited

U.S. PATENT DOCUMENTS

| | | | |
|---|---|---|---|
| 4,334,322 | A | 6/1982 | Clark, III |
| 6,844,841 | B1 | 1/2005 | Masciulli |
| 2004/0009768 | A1 | 1/2004 | Waters |
| 2008/0239980 | A1 | 10/2008 | Niculescu |

FOREIGN PATENT DOCUMENTS

| | | | |
|---|---|---|---|
| EP | 1303069 | A1 | 4/2003 |
| FR | 2952491 | A1 | 5/2011 |

*Primary Examiner* — Ping Hsieh
*Assistant Examiner* — Xin Jia
(74) *Attorney, Agent, or Firm* — Baker & Hostetler LLP

(57) ABSTRACT

A method is provided for selectively, dynamically and adaptively jamming the third-party radio communications that are external to a radio communication network to be protected, which optimizes the effectiveness of the jamming of P predefined areas or positions in a network of transmitters, and which uses closed-loop control to limit fratricidal effects on certain platforms having telecommunication transmitters/receivers to be preserved.

9 Claims, 6 Drawing Sheets

| Transmission network | Reception network | Channel filtering matrix | Spatial and convolutive mixing of the input S by the channel filter in order to produce the output X |
|---|---|---|---|

$$S(t)=\begin{pmatrix} S_1(t) \\ \\ S_N(t) \end{pmatrix} \quad X(t)=\begin{pmatrix} X_1(t) \\ \\ X_N(t) \end{pmatrix} \quad =\begin{pmatrix} H_{11}(t) & & H_{1M}(t) \\ & & \\ H_{N1}(t) & & H_{NM}(t) \end{pmatrix} \quad X(t)=(H*S)(t) \rightarrow \begin{pmatrix} X_1(t) \\ \\ X_N(t) \end{pmatrix} = \left[\begin{pmatrix} H_{11} & & H_{1M} \\ & & \\ H_{N1} & & H_{NM} \end{pmatrix} * \begin{pmatrix} S_1 \\ \\ S_M \end{pmatrix}\right](t)$$

Convolutive temporal mixing between elements n and m of the transmitting/receiving networks $$X_{nm}(t)=(H_{mn}*S_m)(t)$$
$$=\sum_{l=1}^{L_m}\alpha_l^{(m,n)}\left[\sum_{n_l=1}^{N_l}\alpha_{(n_l,l)}^{(m,n)}.\exp\left[i\left((2\pi/\lambda)\cos\theta_{(n_l,l)}^{(m,n)}-\gamma_l^{(m,n)}\right)t+\varphi_{(n_l,l)}^{(m,n)}\right]\right]U_s\left(\theta_{(n_l,l)}^{(m,n)}\right).S_m\left(t-\tau_l^{(m,n)}\right)$$

Convolutive spatio-temporal mixing between element n and transmitted signal vector $s(t)=\begin{pmatrix} S_1(t) \\ \\ S_M(t) \end{pmatrix}$ $$X_n(t)=\sum_{m=1}^{M}X_{mn}(t)=\sum_{m=1}^{M}(H_{mn}*S_m)(t)$$

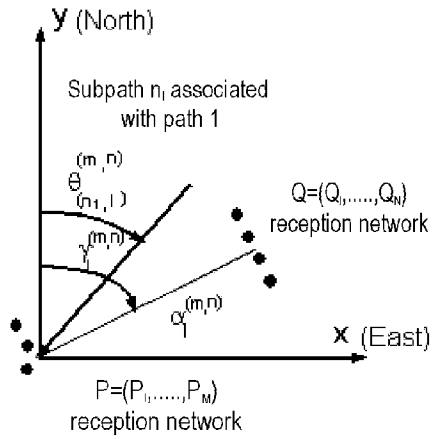

FIG.2

SET OF PLATFORMS TOWARDS SET OF PLATFORMS
DIRECTED NETWORK GRAPH AND GRAPH MATRIX G: SISO LINKS G'=G
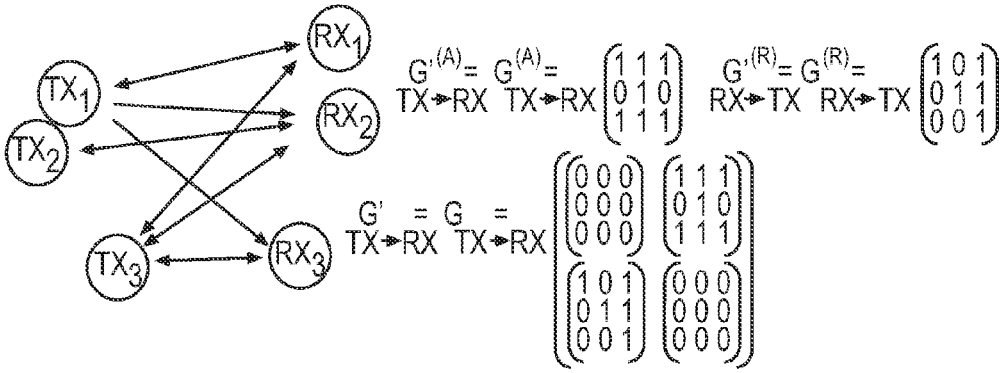
SAME TOPOLOGY WITH DIRECTED NETWORK MACROGRAPH
AND MACROGRAPH MATRIX G' 2X2 MIMO LINKS
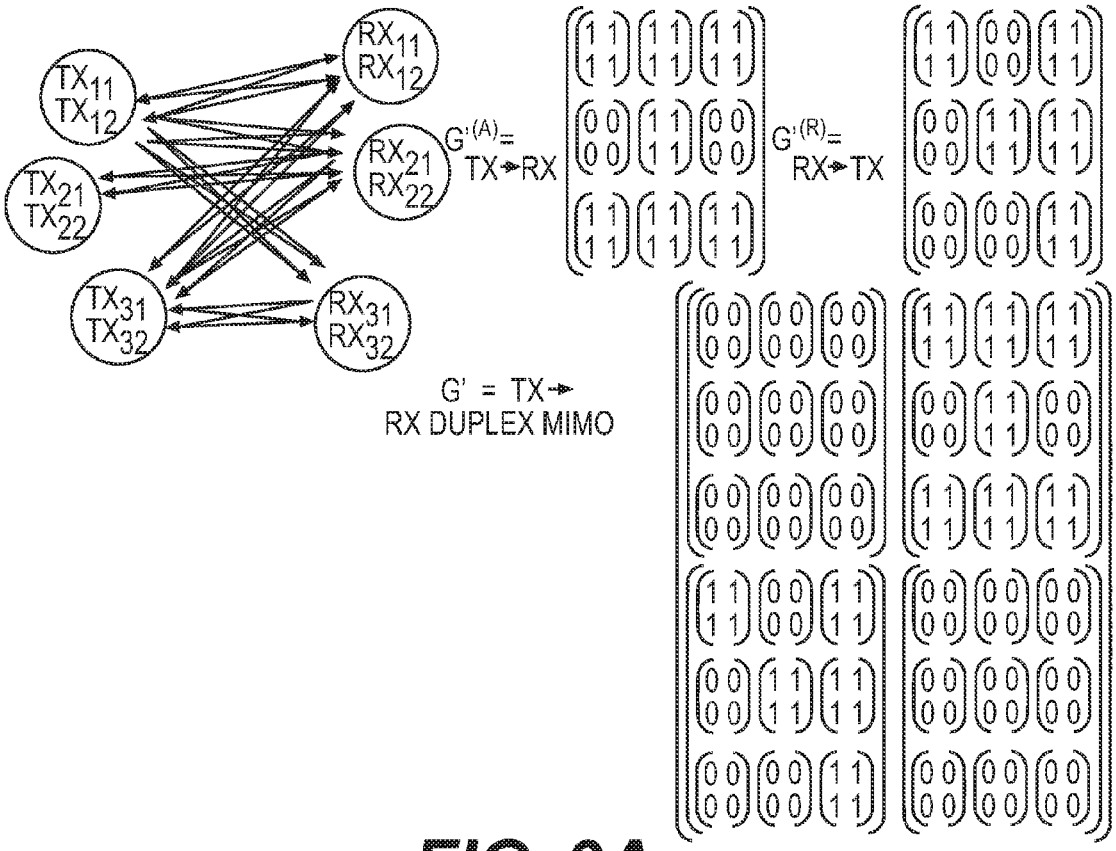
FIG. 3A SAME NETWORK TOPOLOGY WITH MIMO LINKS OF IDENTICAL SIZE KxK' (TRANSMITTERSxRECEIVERS), Tx→Rx SENSE: PROPAGATION MATRICES $G^{(A)}_{mn}$ m=1...M, n=1...N, SIZE KxK'
Rx→Tx SENSE: PROPAGATION MATRICES $G^{(R)}_{mn}$ m=1...M, n=1...N, SIZE K'xK
⇒ DETERMINES THE DIRECTED MACROGRAPH MATRIX G'

$G'_{\text{MIMO DUPLEX}}$ $Tx_1,\ldots,Tx_M \quad Rx_1,\ldots,Rx_N$ $\sum_{\mu-1}^{\mu} K_M$ ELTS → $\sum_{\mu-1}^{\mu} K'_M$ ELTS

SIMPLIFIED CASE $K_M = K_M = K_I$ $K'_N = K'_{N'} = K$-

$MK\mu ELTS \rightarrow NK'\mu ELT$ $$\overset{Tx\to Rx}{=} \begin{pmatrix} \begin{bmatrix} [0](KxK') & [0](KxK') & \ldots & [0](KxK') \\ [0](KxK') & [0](KxK') & & [0](KxK') \\ \ldots & \ldots & \ldots & \ldots \\ [0](KxK') & [0](KxK') & \ldots & [0](KxK') \end{bmatrix} \begin{pmatrix} [G^{(A)}_{11}] & [G^{(A)}_{12}] & \ldots & [G^{(A)}_{1N}] \\ [0](KxK') & [G^{(A)}_{22}] & & [0](KxK') \\ \ldots & \ldots & \ldots & \ldots \\ [G^{(A)}_{M1}] & [G^{(A)}_{M2}] & \ldots & [G^{(A)}_{MN}] \end{pmatrix} \\ \begin{pmatrix} [G^{(R)}_{11}] & [0](K'xK) & \ldots & [G^{(R)}_{M1}] \\ [G^{(R)}_{12}] & [G^{(R)}_{22}] & \ldots & [G^{(R)}_{M2}] \\ \ldots & \ldots & \ldots & \ldots \\ [0](K'xK) & [0](K'xK) & \ldots & [G^{(R)}_{MN}] \end{pmatrix} \begin{pmatrix} [0](K'xK) & [0](K'xK) & \ldots & [0](K'xK) \\ [0](K'xK) & [0](K'xK) & \ldots & [0](K'xK) \\ \ldots & \ldots & \ldots & \ldots \\ [0](K'xK) & [0](K'xK) & & [0](K'xK) \end{pmatrix} \end{pmatrix}$$

*FIG. 3A-continued*

ANOTHER EXAMPLE OF A DIRECTED NETWORK GRAPH WITH GRAPH MATRIX G AND MACROGRAPH MATRIX G' (G'=G) SISO LINKS

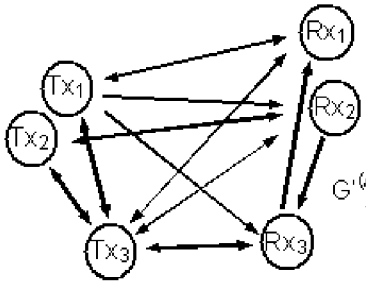

$$G'^{(A)} = G^{(A)} = \begin{pmatrix} \begin{pmatrix} 0&0&1\\0&0&1\\0&0&0 \end{pmatrix} & \begin{pmatrix} 1&1&1\\0&1&0\\1&1&1 \end{pmatrix} \\ \begin{pmatrix} 0&0&0\\0&0&0\\0&0&0 \end{pmatrix} & \begin{pmatrix} 0&0&0\\0&0&1\\0&0&0 \end{pmatrix} \end{pmatrix} \quad G'^{(R)} = G^{(R)} = \begin{pmatrix} \begin{pmatrix} 0&0&0\\0&0&0\\1&1&0 \end{pmatrix} & \begin{pmatrix} 0&0&0\\0&0&0\\0&0&0 \end{pmatrix} \\ \begin{pmatrix} 1&0&1\\0&1&1\\0&0&1 \end{pmatrix} & \begin{pmatrix} 0&0&0\\0&0&0\\1&0&0 \end{pmatrix} \end{pmatrix}$$

$$G' = G'^{(A)} \times G'^{(R)} = \begin{pmatrix} \begin{pmatrix} 0&0&1\\0&0&1\\1&1&0 \end{pmatrix} & \begin{pmatrix} 1&1&1\\0&1&0\\1&1&1 \end{pmatrix} \\ \begin{pmatrix} 1&0&1\\0&1&1\\0&0&1 \end{pmatrix} & \begin{pmatrix} 0&0&0\\0&0&1\\1&0&0 \end{pmatrix} \end{pmatrix}$$

SAME TOPOLOGY WITH DIRECTED NETWORK MACROGRAPH G' AND MACROGRAPH MATRIX 2x2 MIMO LINKS

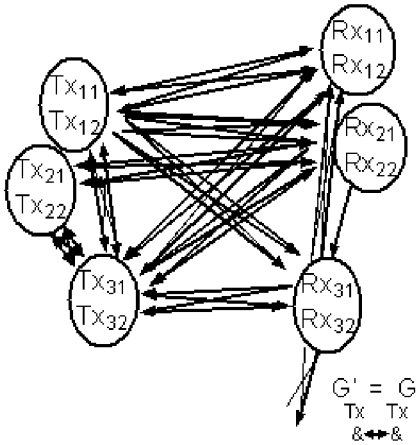

$$G' = G'^{(A)} \times G'^{(R)} = \begin{pmatrix} \begin{pmatrix} \begin{pmatrix} 0&0\\0&0 \end{pmatrix} & \begin{pmatrix} 0&0\\0&0 \end{pmatrix} & \begin{pmatrix} 1&1\\1&1 \end{pmatrix} \\ \begin{pmatrix} 0&0\\0&0 \end{pmatrix} & \begin{pmatrix} 0&0\\0&0 \end{pmatrix} & \begin{pmatrix} 1&1\\1&1 \end{pmatrix} \\ \begin{pmatrix} 1&1\\1&1 \end{pmatrix} & \begin{pmatrix} 1&1\\1&1 \end{pmatrix} & \begin{pmatrix} 0&0\\0&0 \end{pmatrix} \end{pmatrix} & \begin{pmatrix} \begin{pmatrix} 1&1\\1&1 \end{pmatrix} & \begin{pmatrix} 1&1\\1&1 \end{pmatrix} & \begin{pmatrix} 1&1\\1&1 \end{pmatrix} \\ \begin{pmatrix} 0&0\\0&0 \end{pmatrix} & \begin{pmatrix} 1&1\\1&1 \end{pmatrix} & \begin{pmatrix} 0&0\\0&0 \end{pmatrix} \\ \begin{pmatrix} 1&1\\1&1 \end{pmatrix} & \begin{pmatrix} 1&1\\1&1 \end{pmatrix} & \begin{pmatrix} 1&1\\1&1 \end{pmatrix} \end{pmatrix} \\ \begin{pmatrix} \begin{pmatrix} 1&1\\1&1 \end{pmatrix} & \begin{pmatrix} 0&0\\0&0 \end{pmatrix} & \begin{pmatrix} 1&1\\1&1 \end{pmatrix} \\ \begin{pmatrix} 0&0\\0&0 \end{pmatrix} & \begin{pmatrix} 1&1\\1&1 \end{pmatrix} & \begin{pmatrix} 1&1\\1&1 \end{pmatrix} \\ \begin{pmatrix} 0&0\\0&0 \end{pmatrix} & \begin{pmatrix} 0&0\\0&0 \end{pmatrix} & \begin{pmatrix} 1&1\\1&1 \end{pmatrix} \end{pmatrix} & \begin{pmatrix} \begin{pmatrix} 0&0\\0&0 \end{pmatrix} & \begin{pmatrix} 0&0\\0&0 \end{pmatrix} & \begin{pmatrix} 0&0\\0&0 \end{pmatrix} \\ \begin{pmatrix} 0&0\\0&0 \end{pmatrix} & \begin{pmatrix} 0&0\\0&0 \end{pmatrix} & \begin{pmatrix} 1&1\\1&1 \end{pmatrix} \\ \begin{pmatrix} 1&1\\1&1 \end{pmatrix} & \begin{pmatrix} 0&0\\0&0 \end{pmatrix} & \begin{pmatrix} 0&0\\0&0 \end{pmatrix} \end{pmatrix} \end{pmatrix}$$

FIG.3B

DEFINITION OF THE TERM-TO-TERM LOGICAL PRODUCT, GENERAL CASE

A and B matrices of same size NxM.

$$A=\begin{pmatrix} A_{11} & A_{1M} \\ A_{N1} & A_{NM} \end{pmatrix} \quad B=\begin{pmatrix} B_{11} & B_{1M} \\ B_{N1} & B_{NM} \end{pmatrix}$$

A and B: term-to-term product.
Equivalent to the term-to-term logical product
For network graphs $$A\&B=\begin{pmatrix} A_{11}.B_{11} & A_{1M}.B_{1M} \\ A_{N1}.B_{N1} & A_{NM}.B_{NM} \end{pmatrix}$$

DEFINITION OF THE GENERALIZED CHANNEL MATRIX

Channel matrix $$H(\tau)_{Tx_1,\ldots,Tx_M \to Rx_1,\ldots,RxN} = \begin{pmatrix} H_{11}(\tau) & H_{1M}(\tau) \\ H_{N1}(\tau) & H_{NM}(\tau) \end{pmatrix}$$

Network (macro)graph $$G'(\tau)_{Tx_1,\ldots,Tx_M \to Rx_1,\ldots,RxN} = \begin{pmatrix} G'_{11}(\tau) & G'_{1M}(\tau) \\ G'_{N1}(\tau) & G'_{NM}(\tau) \end{pmatrix}$$

Generalized channel $$H'(\tau)_{Tx_1,\ldots,Tx_M \to Rx_1,\ldots,RxN} = \begin{pmatrix} G'_{11}(\tau)\ \&H_{11}(\tau) & G'_{1M}(\tau)\ \&H_{1M}(\tau) \\ G'_{N1}(\tau)\ \&H_{N1}(\tau) & G'_{NM}(\tau)\ \&H_{NM}(\tau) \end{pmatrix} = [G']\ \&\ [H'(\tau)]$$

FIG.4

METHOD FOR JAMMING COMMUNICATIONS IN A CLOSED-LOOP CONTROL NETWORK

CROSS-REFERENCE TO RELATED APPLICATION

This application claims priority to foreign French patent application No. FR 1103578, filed on Nov. 24, 2011, the disclosure of which is incorporated by reference in its entirety.

FIELD OF THE INVENTION

The invention relates to a method for selectively, dynamically and adaptively jamming the third-party radio communications that are external to a radio communication network to be protected, which optimizes the effectiveness of the jamming and which uses closed-loop control to limit fratricidal effects on the telecommunication transmitters/receivers to be preserved. The invention relates to an Multiple Input Multiple Output or MIMO-oriented method for dynamically jamming the third-party communications which uses only the radio interface and performs closed-loop control of fratricidal effects on a network to be protected. The communication network to be protected and the jammer or the network and the jammers are treated as a macronetwork of closed-loop multiple-input-multiple-output or MIMO type and are managed jointly by using return channels from the receivers to be protected in order to adapt the jamming instructions and the transmission instructions.

The method according to the invention is used, by way of example, to jam certain chosen communication links between entities that are external to the network to be preserved, which are present in a certain geographical area, while maintaining the available communication links and services, in a quality that is sufficient and controlled in the communication network to be preserved.

BACKGROUND

The joint use of transmission networks and jammers (or of networks of jammers) by the same force in a theatre of operation in the broad sense, and particularly in terrestrial convoys, in aircraft squadrons and in naval squadrons, is often severely penalized by the absence of precise control over the effects caused by the jammer or jammers on the transmission station or stations of the force's network or networks.

The technical problem to be solved for the jointly used transmission networks and jammers is that of limiting the fratricidal effects of the jammers on the transmission stations, while guaranteeing minimum effectiveness of the jamming on targets or on the areas of interest in the theatre.

DEFINITIONS

Jammer: transmission system capable of transmitting a signal that is intended to prevent the operation of all or some of the equipment using the electromagnetic spectrum (transmission stations, radar or navigation systems that are present in the theatre of operation).

Network of jammers: coordinated set of transmission systems that are capable of transmitting signals intended to prevent the operation of all or some of the equipment using the electromagnetic spectrum and present in the theatre of operation.

"Friendly" transmission station or "friendly station": transmission station defined as being part of the communication system to be preserved and needing to be protected from the effects of the jamming.

"Friendly" transmission network or "friendly network": interconnectable set of "friendly" transmission stations.

Friendly transmission: transmission coming from a friendly station or from a friendly jammer.

"Target" equipment: equipment defined as needing to be affected by the jamming.

Communicating jammer: jammer equipped with a "friendly" transmission station.

Network of communicating jammers: network of jammers equipped with "friendly" transmission stations, constituting a subnetwork of friendly transmissions.

Jamming of a piece of target equipment: transmission of a signal or of a plurality of signals, from a jammer or from a network of jammers, so that the target equipment is prevented from getting to work or from continuing to serve.

Jamming of a geographical area: transmission of a signal or of a plurality of signals, from a jammer or from a network of jammers, so that any piece of target equipment that is present in the geographical area is prevented from getting to work or continuing to serve.

Detection of a signal: ability to decide on the presence of a friendly transmission or of a transmission coming from an external entity and to intercept the signal. This detection is performed in the band and the duration of analysis of one or more interceptors which may be accommodated by the friendly transmission stations, for example.

Detection of a transmitter: ability to decide on the presence of a transmitter in the theatre by detecting the signal or signals which it transmits.

Localization of a transmitter: ability to decide on the location of a transmitter in the theatre by detecting the signal or signals that it transmits.

SISO: single input single output: refers to a transmission system having one transmitting channel Tx and one receiving channel Rx.

SIMO: single input multiple output: refers to a transmission system having one Tx channel and N Rx channels.

MISO: multiple input signal output: refers to a transmission system having M Tx channel and one Rx channel.

MIMO: multiple input multiple output: refers to a transmission system having M Tx channels and N Rx channels.

Effectiveness of an area: signifies the level of prevention of the setup and/or maintenance of third-party communications that corresponds to the stations and infrastructures that are present in this area, i.e. prevention of all communications other than protected communications in the area.

Fratricidal effects: level of prevention of the setup and/or maintenance of communications which need to be protected, owing to residual jamming and interference outside the effective jamming area.

The estimation of the propagation channels corresponds to estimation of the impulse response of the propagation channel, or the numbers, amplitudes and phases of the various multiple propagation paths, between jammer(s) and protected receiver(s), which allows adaptation of power and the spatio-temporal modulation/coding scheme in the network of the jammer or in the network of jammers in order to minimize or quash the impact on the demodulator/decoder of the protected receiver(s). At the same time and in parallel, the impulse response measured on the transmitters allows—as in an MIMO network—optimization of the protected transmission links by means of adaptation of the modulation/coding schemes of the protected transmitters and receivers.

The field of jamming has been the subject of numerous works and inventions. However, fratricidal effects are still dealt with fairly poorly in developments known to date. In general, the constraints associated with implementing the methods and systems known to the applicant have the notable effect of drastically limiting the scopes and the number of simultaneous friendly radio communications, or even of preventing the use of friendly radio communications.

SUMMARY OF THE INVENTION

The subject matter of the present invention relates, notably, to a method which will allow the effective limitation of fratricidal effects with sufficient flexibility and scope to simultaneously allow jamming of the targets or areas to be jammed and the operation of communications between friendly stations in an operational context.

The method and the system implemented by the present invention are based notably on the use of the following elements:

- jammers that are programmable and dynamically configurable in terms of waveform (envelope, modulation, amplitude, phase, etc.), frequency map (choice of bands among bands and carriers for the jamming signal), temporal transmission pattern (recurrence of transmissions on the basis of time, frequency, waveform, etc.), and that are managed by a centralized or dispersed control component,
- sequences of digital signals transmitted by the jammers, specifically intended to allow precise transmission channel measurements, and jamming power measurements in the friendly stations,
- sequences of digital signals transmitted by the friendly transmitters, specifically intended to allow precise transmission channel measurements, and jamming power measurements in the friendly stations,
- communications between networks of jammers or a component for managing the network of jammers, and a friendly network or a control component in the friendly network, (return channels, instructions to the jammers, etc.),
- a control component allowing the preparation of transmission instructions for the jammers with a control loop based on the measurements taken in the interceptors on the signal sequences and on the estimation of the propagation channels.

The invention can be implemented on any friendly stations provided that:

- the transmitters implement signal sequences as specified above,
- the receivers are able to take the measurements on the jamming signals and to deliver all of the measurements (on transmitter signals and jammer signals), or else the antenna elements of the receiver are able to be coupled to interceptors taking these measurements.

The description below of the methods and systems implementing the present invention is based notably on/

- a formal description of the interactions between friendly transmitting stations (denoted by Tx for short), friendly receiving stations (denoted by Rx for short), jammers (denoted by Br for short) and external entities to be jammed (denoted by Ci for short), by means of graphs and macrographs which will be clarified below,
- on a general propagation model for the transmission channel, generalized in consideration of the effective interactions between friendly transmitting and receiving stations (Tx, Rx) (generally integrated together within a friendly transmission station), jammers (Br) and external entities (Ci), through a generalized channel matrix notion that is clarified below,
- on a formation then resolution of a problem of optimization under constraints, clarified below.

The subject matter of the invention relates to a method for optimizing the jamming of P predefined areas or positions in a network of communication transmitters, jammers and receivers comprising a plurality N_pl of platforms, a number M≤N_pl of said platforms being equipped with antennas and systems for transmitting useful transmission signals, a number N≤N_pl of said platforms being equipped with antennas and systems for receiving useful transmission signals, a number J≤N_pl of said platforms that are managed by a master station being equipped with jamming systems and antennas suitable for preventing the transmissions between entities that are external to said network, said platforms constituting an interplatform network, characterized in that it comprises at least the following steps:

- measuring the useful communication signals received by all of the N reception platforms, taking these measurements as a basis for estimating the M*N useful propagation channels, and transmitting these measurements to the master station managing the platforms equipped with the jamming antennas,
- measuring all of the jamming signals received by the N reception platforms, taking these measurements as a basis for estimating the J*N fratricidal propagation channels, and transmitting these measurements to said master station,
- taking the measurements of the useful communication signals and propagation channels and of the jamming propagation signals and channels as a basis for calculating, in the master station, jamming instruction values, such as the jamming signals, the recurrence of the transmissions, the carrier frequencies for the transmissions, the leads/delays upon transmission in relation to a synchronization reference, the radiated equivalent powers, the amplitude and phase weightings on the transmitting antenna networks, guaranteeing an effectiveness for the P areas to be jammed corresponding to the entities that are external to the network, while minimizing the fratricidal effects on the N receiving platforms,
- transmitting these instructions to the J platforms equipped with a jamming antenna,
- taking the first calculated and applied instructions, while continuously making use of the measurements from the fratricidal propagation channels coming from the receiving platforms, as a basis for optimizing by means of iteration the jamming of the areas to be jammed while maintaining fratricidal jamming which is acceptable for the quality of the useful transmissions.

By way of example, the method uses the measurement from the propagation channels coming from the N reception platforms in order to jointly optimize the jamming and quality of the useful transmissions on the transmitting platforms by adapting the transmission power levels, and/or the spatio-temporal coding schemes and/or the transmission protocols in the time/frequency domain of the jammers and the transmitters.

According to one implementation variant, the master station used is one of the transmission network nodes which is associated with a component for calculating the instructions intended for the jammers.

By way of example, it uses programmable jammers that are suitable for dynamically taking into account transmission instructions, on the power and/or on temporal parameters, the waveform, spatio-temporal coding, the amplitude-phase weighting.

By way of example, the method is used in transmission networks using the MIMO, MISO, SIMO or SISO protocol with a return channel from the receivers to the transmitters.

According to another implementation variant, the method is used in a radio network in which the receivers are suitable for measuring channel values on the useful transmitters and on the jammers.

By way of example, the method is used in a radio network in which the reception stations have antenna elements that are coupled to an interceptor taking the channel measurements on the useful transmitters and on the jammers.

BRIEF DESCRIPTION OF THE DRAWINGS

Other features and advantages of the present invention will become more apparent on reading the appended description of the figures, which is provided by way of illustration and is by no means limiting, in which:

FIG. 2 shows a specific example of a propagation channel model generalized for the MIMO case, with definitions and denotations for the pertinent geometrical and physical quantities, FIGS. 3A and 3B show an illustration of the notions of network graph and macrograph which are used to describe the links between friendly stations (Tx, Rx), the interactions between jammers (Br) and external entities to be jammed, FIG. 4 shows a logical product between network graph and channel matrix, defining a generalized channel matrix which takes account both of the links or interactions between the players, transceivers, jammers, areas or points to be jammed, and propagation channels between these players.

DETAILED DESCRIPTION

Figure 1:
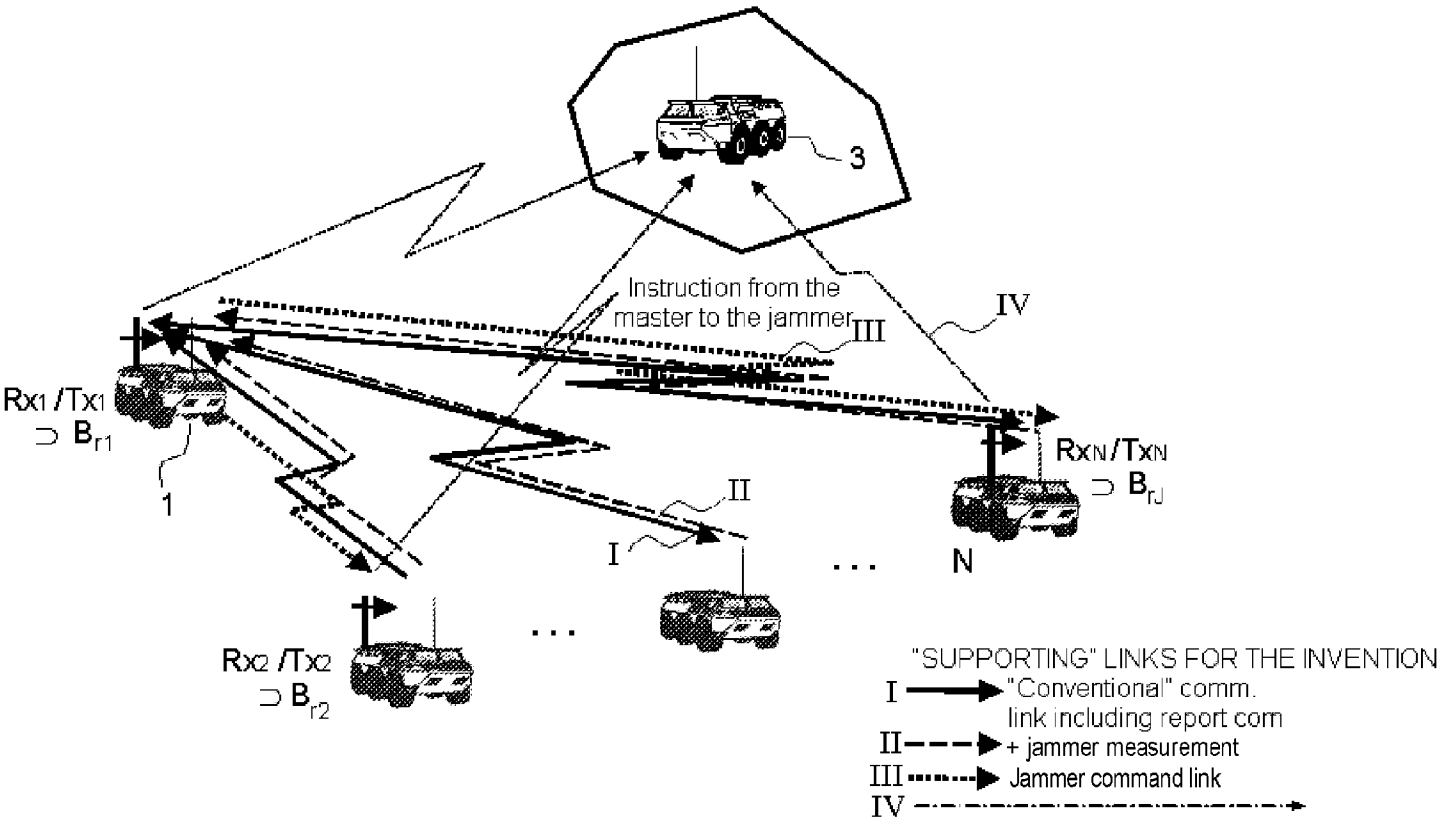
FIG. 1 shows an example of architecture for the system according to the invention.

The example below is provided by way of illustration and in by no means limiting fashion for a system having N_pl transmission platforms which have MIMO, MISO, SIMO or SISO (a single listening antenna) communication stations.

FIG. 1 schematically shows an example of architecture for a transmission network in which the method according to the invention can be implemented. A master station 1 is linked by radio communication channel to N_pl−1 friendly transmitter/receiver platforms or stations, for example, that is to say stations equipped with a transmitting part Tx and with a receiving part Rx. Among these N_pl platforms, J "jammer" platforms, $B_{r1}, \ldots B_{rJ}$, have a jamming antenna, of omnidirectional type, of directional type or of network type. The friendly platforms ("jammers" or without a jammer) thus have an interplatform communication network which appears as a macronetwork when all of the antenna elements are considered. FIG. 1 also shows an area to be jammed 3, which may contain radio equipment external to the network of friendly stations. The master station 1 receives the common signal measurements and the jamming signal measurements from the N stations $R_{x1} \ldots R_{xN}$. The master station transmits the jamming instructions to the J jammers $B_{r1}, \ldots B_{rJ}$.

The transmission network may be made up of a plurality of nodes, and it is possible for the master station used to be one of the nodes or platforms of the transmission network that is associated with a component for calculating the instructions intended for the jammers.

The communication links are shown in the following manner:

I: conventional common link including all of the measurements taken on the communication or "reporting" links (measurements taken by the interceptors on the sequences of signals transmitted by the friendly transmitters Tx, for example in the friendly Rx stations) that are retransmitted by return channel to the friendly Tx stations and/or to the master station of the jammers, II: link comprising the "reporting" of the measurements on a jammer signal, i.e. all of the measurements taken on the jammer signals (measurements taken by the interceptors on the sequences of signals transmitted by the jammers Br, for example in the friendly Rx stations) that are retransmitted by return channel to the master station of the jammers and/or to the friendly Tx stations, III: command link used to support the broadcasting and application of the instructions from the master station by the jammers, and IV: transmission of the jamming signals to the targeted area 3 and/or to the entities Ci that are external to the friendly network.

The method implemented by the invention is based notably on:

- the recordings/measurements of the communication signals received by the interceptors, which are the friendly stations, for example,
- the recordings/measurements of the jamming signals interfering with the friendly stations.

In the rest of the description, the channels are determined as being made up of all of the radio propagations between each of the transmitters (jammer or friendly communication transmitter) and each of the friendly communication receivers or each of the targets or areas to be jammed Ci (the areas to be jammed being discretized in the form of lists of points to be jammed).

The channel matrix is the matrix of the combinations of radio propagation channels between the transmitters and the receivers (Tx Rx channel matrix), between the jammers and the receivers (Br Rx channel matrix) or between the jammers and each of the points to be jammed (Br, Ci channel matrix). These matrices are considered in a first global approach between the platforms (and not between the antenna elements), and the value ai,j of an element of the channel matrix thus physically and globally describes the radio channel between the platform i and the platform j. When a friendly receiver comes into play, the matrix is informed on the basis of the measurements taken on the useful and jamming signals. When an area or a point to be jammed comes into play, the matrix is informed on the basis of a propagation model between a jammer Br and a target Ci. All of these matrices are then considered in a second approach between each transmission antenna element (each platform may be equipped with a plurality of transmission antennas, for example a jamming antenna and a transmission antenna, which are themselves made up of networks of elements) and each reception antenna element (each platform may be equipped with a plurality of reception antennas, which are themselves made up of networks of elements). For each of the approaches, the first level of description of this matrix is binary ai,j=1 if the platform, or the antenna, j receives a signal from the platform (or the antenna) i, and a finer level in the second approach, in particular, corresponds to considering ai,j as the impulse response of the channel i,j, which totally characterizes a multiple input multiple output or MIMO, multiple input single output or MISO, single input multiple output or SIMO, or single input single output or SISO linear channel. This impulse response can be estimated according to the measurements taken by the friendly Rx receivers on the signal sequences, or according to the propagation models considered between jammers and the target or area to be jammed.

Knowledge of the positions of the stations is useful for optimizing the operation of the communication network and is necessary for optimizing the jamming. Synchronism or precise dating of the measurements is also useful for better global optimization. Similarly, precise knowledge of the signal sequences contained in the jamming or communication signals is necessary for the measurement of the propagation channels by the friendly Rx receivers and contributes to global optimization.

The graphical representations provide the advantage of offering a synthetic representation of all of the interactions between the players. By way of example, it is possible to show the platforms or the antennas by placing an arc between two platforms or antennas if the signal transmitted by one is received by the other, and therefore if the channel has been able to be measured.

Example Provided for the Implementation of the Method According to the Invention "Useful" MIMO, MISO, SIMO, SISO communication stations are available on platforms numbering N_PI, of which J platforms have jammers.

"Useful"

Thus, N_pl communication platforms are available. Each of these platforms is MIMO, MISO, SIMO or SISO. $M_1$, $M_2 \ldots, M_{N_pl}$, denotes the number of transmitting antenna elements of each of these platforms. $N_1, N_2 \ldots, N_{N_pl}$ denotes the number of receiving antenna elements of each of these N platforms.

The network made up of the $\Sigma_{M_p1}=\Sigma_{m=1 \ldots N_pl} M_m$ transmitting antenna elements Tx or Br and of the $\Sigma_{N_pl}=\Sigma_{n=1 \ldots N_pl} N_n$ antenna elements Rx appear as a macronetwork, a priori largely incomplete. All of the communication platforms make up a network that is represented by the network graph of size N_pl as defined above and denoted by G0. When all of the antenna elements are considered, it is preferred to represent them by means of the macrograph of size $\Sigma_{M_pl+N_pl}$ as defined above and denoted by G0'.

The channel matrix of this macronetwork made up of N_pl platforms and $\Sigma_{M_pl+N_pl}$ antenna elements can be written formally, as will be clarified below or as can be seen in FIGS. 3A, 3B and 4, in the generalized form H0'(Tx,Rx)=G0'$\propto$ [H0$^{(A)}$(Tx,Rx), H0$^{(R)}$(Rx,Tx)]. It is determined by the topology of the network (which determines G0 and G0') and the channel matrices H0$^{(A)}$ and H0$^{(R)}$ that are proper to each $Tx_m \rightarrow Rx_n$ link. The $Tx_m \rightarrow$master station communication links comprise the return lines for low-speed messaging systems intended to transmit the data about the channel measurements and about the quality measurements for the transmission to the master station in order to adapt and optimize the transmission instructions.

In the method implemented, called a "closed-loop" method, the transmitters, receivers and communication nodes in the friendly network manage, at each instant t (sampling $t_k$, k=1, 2, . . . ), the communication links and the pertinent parameterizations (protocols, bit rates, coding and modulation schemes, if need be, the weighting of the transmitting/receiving antenna networks, use of relays, etc.), while adapting themselves to the radio environment and to the possible jamming residues, but without being explicitly guided by the control component. It is the jamming itself that is controlled by means of the estimation and minimization of the residual fratricidal effects.

All of the antenna networks of the transmitters $Tx_1, \ldots, Tx_m$ (M≤N_pl) and of the receivers $Rx_1, \ldots, Rx_N$ (N≤N_pl) are therefore formalized as a macronetwork G0' (defined by a matrix of size $(\Sigma_{M_pl}+\Sigma_{N_pl})^2$), the links of which are fully described as in FIG. 4 by a generalized channel matrix which determines the full (or "round-trip") generalized channel H0' (Tx,Rx,τ). These matrices are determined by the topology of the network macrograph G' by the channel matrices that are proper to each $Tx_m \rightarrow Rx_n$ link. The formal construction of these matrices is shown in FIG. 4, examples in FIGS. 3A and 3B and in FIG. 2 show the consideration of the propagation channel for constructing the channel matrices that are proper to each $Tx_m \rightarrow Rx_n$ link. For the $Tx_m \rightarrow Rx_n$ crossing, the formal expression of the useful signals coming from the transmitting platforms and received by the receiving platforms is thus as follows at each instant t:

$$X(t) = (H0' * S)(t)$$

i.e.

$$\begin{bmatrix} X_1(t) \\ \\ X_N(t) \end{bmatrix} = \left[\begin{pmatrix} H0'_{11} & H0'_{1M} \\ \\ H0'_{N1} & H0'_{NM} \end{pmatrix} * \begin{pmatrix} S_1 \\ \\ S_M \end{pmatrix}\right](t)$$

where

N is the exact number of receiving platforms having a reception antenna (N N_pl), M is the exact number of transmitting platforms having a transmission antenna intended for useful transmissions (M N_pl), H0' is the generalized "transmitters to receivers" channel matrix, $X_n(t)$ n=1, . . . , N is the vector of the useful signals received on the network of the antenna elements of the receiving platform indexed n, $S_m(t)$ n=1, . . . , M is the vector of the signals transmitted on the network of the antenna elements of the transmitting platform indexed m, in band B.

FIG. 2 also shows the geometry of the propagation on an axis X(east), Y(north).

The link between the element indexed m in the network of transmitting platforms and the element indexed n in the network of receiving platforms is characterized by:

$S_m(t)$ as mentioned above, $X_{nm}(t)$, the contribution vector of the signal Sm received on the element n in the receiving antenna network, $X_n(t)$ as mentioned above, $L_{mn}$ the number of paths in the propagation channel, I the index of the I-th multipath, $\alpha^{(m,n)}$I the attenuation of the path I relative to average losses, $\gamma^{(m,n)}$I, the average direction of arrival of the path I, $\tau^{(m,n)}$I, the average delay in the path L, the delays being contained in a range

[O, $T^{(m,n)}$] depending on the urban, mountainous, etc. channel, $N^{(m,n)}$ is the number of subpaths associated with the path I that are supposed to be indiscernible to the band-B signal and are therefore distributed within a range of duration $T^{(m,n)} \ll 1/B$, $n_I$ is the index of the subpath I, $\phi^{(m,n)}{}_{nI,I}$ is the phase of the subpath indexed I and $n_I$, $\alpha^{(m,n)}{}_{nI,I}$ is the relative level of the subpath indexed I and $n_I$, $\theta^{(m,n)}{}_{nI,I}$) the direction of arrival of the subpath indexed I and $n_I$, $U_s(\theta^{(m,n)}_{nI,I})$ is the directional vector corresponding to the subpath indexed I and $n_I$ for the signal source s.

"Jammers"

Moreover, J platforms among the N_pl are equipped with "jammers" suitable for jamming the communications of the elements that are external to the friendly network, which are denoted by $Br_1, \ldots, Br_J$. All of the jammers $Br_1, \ldots, Br_J$ and receivers and $Rx_1, \ldots, Rx_N$ make up a "jamming" network represented by an interference graph denoted by GJ and subject to a generalized propagation channel HJ'=GJ' & $H_J$(Br, Rx) defined according to the process described in FIG. 4, while considering the number of transmitting platforms J, the number of receiving platforms N and the associated J×N elemental channel matrices.

All of the useful transmitters $Tx_1, \ldots, Tx_M$, jammers $Br_1, \ldots, Br_J$ and useful receivers $Rx_1, \ldots, Rx_N$ make up a network of "interference/jamming" that is represented by an interference graph denoted by GJ and subject to a generalized propagation channel HJ'=GJ' & $H_J$(Br,Rx) defined according to the same process as in FIG. 4, while considering the number of transmitting platforms M+J, the number of receiving platforms N and the associated (M+J)×N elemental channel matrices.

Each of the jammers $Br_j$, indexed j, has an equivalent power level radiated during transmission (PIRE) that is defined by a range [0, $PIREMAX_j$] with which the following are associated for implementation of the invention:

a power level instruction $C_PIRE_j$, a jamming signal $B_j$, one or more jamming durations $Tb_j$ with recurrences $Rb_i$ and a lead or delay $\tau_j$ in transmission of the signal $B_j$ in relation to an instruction coming from the master station, one or more jamming frequency ranges denoted by $Fb_j$ that correspond to the jamming ranges, amplitude $A_j$ and phase $\phi_j$ weightings, if need be, an antenna orientation $\Psi_j$ which will be classed below as spatial weighting caused by the antenna directivity.

The master station indicates to the jammers the power levels PIRE, the jamming signals, the durations of the jamming signals, the recurrences with which these signals appear, the delays, the frequencies and the weightings $A_i$ $\phi_i$ $\psi_i$ to be applied, using a specific communication link. The friendly communication network allows the master station to be informed in real time (that is to say at each instant t or at each temporal sample $t_k$) and allows the jammers to be managed on the propagation channels Br–Rx (received useful levels, received interference, multipaths, etc.) and on the fratricidal effects caused by the signals $B_j$ j=1 . . . J.

"Jammer Interference":

According to the above, all of the antenna networks of the jammers $Br_1, \ldots, Br_J$ and the reception antenna networks of the receiving platforms $Rx_1, \ldots, Rx_N$ are formalized by two interference macronetworks that are defined by:

a "fratricidal network jamming" macrograph, denoted by GJ', that integrates the transmissions by the single jammers and the associated generalized channel matrix HJ' (FIGS. 2, 3A and 3B), a "fratricidal jamming+network interference" macrograph, denoted by GI', that integrates the useful transmitters and the jammers, and the associated generalized channel matrix HI' (FIGS. 2, 3A and 3B).

The formal expression J(t) of the interfering/jamming signals received on a receiving network is thus as follows at any instant t:

limiting oneself to the signals coming from the single jammers Br:

$$J(t) = (HJ'^{(A)} * B)(t)$$

i.e.

$$\begin{bmatrix} J_1(t) \\ \\ J_N(t) \end{bmatrix} = \left[\begin{pmatrix} HJ'_{11} & HJ'_{1J} \\ \\ HJ'_{N1} & HJ'_{NJ} \end{pmatrix} * \begin{pmatrix} B_1 \\ \\ B_J \end{pmatrix}\right](t)$$

where

N is the exact number of receiving platforms having a reception antenna (N≤N_pl), J is the exact number of platforms having a jamming antenna (J≤N_pl), $HJ'^{(\ )}$ is the generalized "jammers to receivers" channel matrix, $J_n(t)$ n=1, . . . , N is the vector of the jamming signals received on the network of the antenna elements of the receiving platform indexed n, $B_j(t)$ j=1, . . . , J is the vector of the jamming signals transmitted on the network of the antenna elements of the platform indexed j.

"Targets and Jammers":

Network of Jammers:

All of the antenna networks of the jammers $Br_1, \ldots, Br_J$ and at the target points $Ci_1, \ldots, Ci_P$ are formalized in the manner of the above by a jamming macronetwork that is defined by:

a "jammernetwork macrograph", denoted by GB', and the generalized channel matrix HB', which are determined by the topology of the jammers and of the target areas (which determines GB'), the models of channel matrices that are proper to each "jamming" of $Br_j$ in the direction of $C_p$, which determine HB' (cf. FIGS. 2, 3A, 3B and 4).

The formal expression of the jammer signals for the target points is thus as follows at each instant t:

$$Z(t) = (HB' * B)(t)$$

i.e.

$$\begin{bmatrix} Z_1(t) \\ \\ Z_P(t) \end{bmatrix} = \left[\begin{pmatrix} HB'_{11} & HB'_{1J} \\ \\ HB'_{N1} & H'_{NJ} \end{pmatrix} * \begin{pmatrix} B_1 \\ \\ B_J \end{pmatrix}\right](t)$$

Network of the Useful Transmitters+Jammers:

All of the contributions by antenna networks of the useful transmitters $Tx_1, \ldots, Tx_M$ to the jamming of the target points $Ci_1, \ldots, Ci_P$, denoted by $bi_1, \ldots, bi_P$ below, can also be considered and formalized by a macronetwork of caused jamming that is defined by a macrograph for the "useful transmitters", denoted by Gbi', and the generalized channel matrix Hbi', which are determined by the topology of the transmitters and of the target areas (which determines Gbi') and the models of channel matrices that are proper to each "radio link" from $Tx_m$ to $Ci_p$, which determine Hbi'.

The formal expression of the jamming signals thus becomes the following at each instant t:

$$bi(t) + Z(t) = \left(\left[\,(HB') \quad (Hb')\,\right] * \begin{pmatrix} S \\ B \end{pmatrix}\right)(t)$$

-continued i.e.

$$\begin{bmatrix} Z_1(t) \\ Z_P(t) \end{bmatrix} = \left[\begin{bmatrix} Hbi'_{11} & Hbi'_{1M} \\ Hbi'_{N1} & Hbi'_{NM} \end{bmatrix} \begin{bmatrix} HB'_{11} & HB'_{1J} \\ HB'_{N1} & H'_{NJ} \end{bmatrix}\right] * \begin{bmatrix} \begin{pmatrix} S_1 \\ \\ S_M \end{pmatrix} \\ \begin{pmatrix} B_1 \\ \\ B_J \end{pmatrix} \end{bmatrix}(t)$$

"Jammer Signal Optimization Instruction":

Moreover, each of the jammers applies at each instant t an instruction denoted by $Cons__j(t)$ that corresponds to a set of parameters defined in a field of values that is formerly denoted $Dom_C_j$.

$Dom_C_j$ is a set defined by the possible parameterizations of the jamming transmissions:

- a value $PIRE_j$ to be chosen in the range [PIREMINj, PIREMAXj] (a constraint PIREMINj>0 is necessary in order to prevent the solution to the optimization problem from systematically converging 0 to the initialization and/or in the transitory phase),
- a jamming signal $b_j$ in a discrete and a finite preprogrammed set of signals,
- one or more jamming durations $Tb_j$ with the recurrences $Rb_i$ and a lead or a delay in transmission $\tau_j$, all of these values being limited by predefined limit values $Max_Tb_j$, $Max_Rb_j$, $Max_|\tau_j|$,
- one or more frequency ranges, denoted by $Fb_j$, that are limited by limit values [Fb_min, Fb_max],
- relative amplitude $A_j$, phase $\phi_j$ and relative directivity $D_j$ weightings that are limited by limit value ranges, respectively [√(PIREMINj), √(PIREMAXj)]; [0.2π] and [0.1].

In practice, if $b_j(t)$ denotes the jamming waveform transmitted by the jammer Brj, the jamming signal vector is formally defined by $b_j(t)$ and $Cons__j(t)$: all of the instructions applied to the jamming waveform $b_j(t)$.

The output provides a jamming signal vector $B_j(t)$ of dimension denoted by $M_{Bj}$ which takes the following form, similar to the general formulation of a signal transmitted at the antenna output:

In baseband:

$$B_j(t) = D_j(\psi_j, t) \cdot b_j(t-\tau_j) \cdot \begin{pmatrix} A_{j,1}(t) \cdot e^{\varphi_{j,1}(t)} \\ \cdots \\ A_{j,M_{Br_j}}(t) \cdot e^{\varphi_{j,N_{Br_j}}(t)} \end{pmatrix}$$

$$= D_j(\psi_j, t) \cdot b_j(t-\tau_j) \cdot \vec{s}_{B_j}(t)$$

On carrier $f_0$:

$$B_j(t) = \mathrm{Re}\left\{ e^{2j\pi f_0 t} \cdot D_j(\psi_j, t) \cdot b_j(t-\tau_j) \cdot \begin{pmatrix} A_{j,1}(t) \cdot e^{\varphi_{j,1}(t)} \\ \cdots \\ A_{j,M_{Br_j}}(t) \cdot e^{\varphi_{j,N_{Br_j}}(t)} \end{pmatrix} \right\} =$$

$$\mathrm{Re}\left\{ e^{2j\pi f_0 t} \cdot D_j(\psi_j, t) \cdot b_j(t-\tau_j) \cdot \vec{s}_{B_j}(t) \right\}$$

Where, for example:

- $M_{Br,j}$: is the number of antenna elements of the network used to transmit the jamming signal from the platform j, each antenna element having the directivity $D_j(\psi_j,t)$, that is supposed to be identical in order to simplify writing,
- $b_j(t-\tau_j)$ is the baseband waveform of the jamming signal transmitted by the platform j, delayed by $\tau_i$, and supposed to be identical over all the elements of the transmission network in order to simplify,
- $A_{j,m}(t)$, $\phi_{j,m}(t)$ are the amplitude and phase weightings of the jamming signal on the element m of the antenna network of the jamming platform j,
- $S_{Bj}$ is the guiding vector of the jamming signal transmitted by the platform j, formed by the amplitude and phase weightings $A_{j,m}(t)$ and $\phi_{j,m}(t)$,
- $f_0$ is the carrier frequency of the jamming signal following transposition.

All of the parameters other than the application of a delay, the choice of transmission frequencies or subbands and a choice of the waveform apply linearly to the jamming signal and correspond to a convex admissible domain.

"Target Area or Target Receiver"

The J platforms $Br_1 \ldots Br_J$ are intended to jam one or more targets or areas characterized by a list of positions $Ci_1 \ldots Ci_P$ to be jammed. These positions are firstly geographical but may, by extension, be defined "in the broad sense" in the time/frequency/space domains:

- in the time domain: the area Ci may correspond to time slots to be jammed which are indexed on a pseudoperiodic frame that is known and/or controlled by the master station of the jammers,
- in the frequency domain: the area Ci may correspond to jamming subbands to be jammed either in a known manner or in a periodic manner (with indexing on a pseudoperiodic frame) that is known and/or controlled by the master station of the jammers,
- in the space domain: the area Ci may correspond to the position of an identified target, to a geographical area around this position, to a focus towards this position. This allows consideration of a channel matrix $H_{BC}$ for the jammers towards the target areas (which is reduced in the case of a single jamming area to a line vector 1×J), for which the default values can be determined as a function of a geometrical model or an empirical model of isotropic average attenuation depending on the distance or any other parametric or empirical model (the target area does not a priori inform the jammers of the effectiveness of the jamming . . . the jammer network can thus initiate its jamming strategy only on the basis of a model, and only then can it control the effectiveness of the jamming if need be—for example using a technique known by the acronym look-through).

The measurement results from the interceptors, for example implemented in the friendly receivers, are used to calculate instructions in a master platform which manages the jammers (centralized control/command):

- the useful signals and the measurement and equalization procedures for these signals in the interceptors, notably on synchronization sequences or pilot sequences, allow the M×N useful communication channels to be estimated,
- the jamming signals, which also integrate known sequences, measurement and equalization procedures for these signals, apply in the same way to these signals in the interceptors.

The results of the measurements are communicated to the control component of the master station.

In order to estimate the JxN jamming channels on the targets Ci, the master station extrapolates the determination of the propagation channel (obtained from friendly Rx) to the $Br_j \rightarrow C_p$ propagation channel (based on behavioural models for channels, for example).

The master station optimizes the reception of the useful communications by means of amplitude and phase instructions sent to the jammers which allow minimization of the fratricidal levels received by the reception antennas (instruction=minimization of fratricidal jamming under the constraint of Tx average power or under another constraint) while maintaining the objective of performance on the targets Ci.

Minimizing the fratricidal effects on the N reception platforms involves, schematically, guaranteeing tolerable fratricidal effects at the same time as jamming.

Guaranteeing tolerable fratricidal effects comes down to minimizing or guaranteeing a level lower than a certain limit for the impact of the signals coming from the jammers, on the signal-to-noise ratio+residual interference+jamming at the output of the demodulators/decoders to be protected, the level limits in question are dependent precisely on the waveform and on the demodulation/coding scheme and on the structure of the network to be protected. By way of example, a common order of magnitude for such a threshold is a binary error rate or BER that is caused by the residual interference and jamming of $10^{-3}$ at the demodulation output, which translates into a threshold on the S/J level at reception depending on the modulation (in the order of 7 dB for conventional single-carrier BPSK modulation received with a strong signal-to-noise ratio S/N).

Guaranteeing effective jamming comes down to maximizing the level of jamming or to obtaining a level of jamming that is higher than a given threshold at the points in the area to be jammed: there again, the minimum effectiveness thresholds are dependent on the robustness of the target stations that are intended to be jammed, but except for very specific cases (PN waveform) generating a J/S (jamming over signal) ratio higher than 0 dB in the band of the target receiver is sufficient to guarantee the effectiveness of the jamming.

The station optimizes spatio-temporal coding in the network of jammers under the previous constraints.

Implementation Variants

1/Nature of the instructions and jamming modes:

sectorial min/max/average power spatio-temporal pattern

2/In one variant of the method, instructions can likewise be prepared and broadcast to the friendly transmitters.

3/Nature of the spatio-temporal schemes implemented in the friendly transmitting stations:

single spatial redundancy between Tx channels and temporal redundancy

ST scheme that is robust in the Rx with respect to external interference (i.e. non-multipath)

use of one of the Tx antennas for the jamming signal on each MIMO Tx and of the other Tx antennas for the communication formation of jamming "spatial channels" with a transmitting subnetwork (incomplete) of "hybrid" communication/jammer MISO Tx.

4/Nature of the spatio-temporal filters implemented in the friendly receiver stations Various spatio-temporal filter solutions can be implemented. A nonexhaustive and nonlimiting list is given below:

Jammer Cancellation

SIMO by means of channel formation (CF) or by means of adaptive spatial filtering (ASF)

Optimum filter in the presence of external interference

Rejection filter making use of the known jammer F.O. apriority etc.

Optimization in the Control Component of the Master Station

Given the topology of the networks and the useful transmission signals $S_1, \ldots, S_M$, an instruction vector Cons= $(Cons_1, \ldots, Cons_J)$ is sought at each instant $t= \ldots, t_{k-1}, t_k, \ldots$ in the "admissible" definition domain $Dom_C_1 \times \ldots \times Dom_C_J$ inducing the jamming signal vector $B=(B_1, \ldots, B_J)^T$ and verifying a plurality of constraints such as those clarified below.

(i) At least one "BC constraint" linked to the expected effectiveness of the jamming, which can be written in several forms on the basis of the above, revealing one of the following convex functionals:

a BC1-type constraint relating to the maximum level of average jamming or of average "jamming+useful residual" on the target points $Ci_p$ $$(Cons_1, \ldots, Cons_J) \in (Dom_C_1 x \ldots x Dom_C_J)$$

implementing $$\underset{\substack{Cons_1, \ldots, Cons_J \\ \in (Dom_C_1 x \ldots x Dom_C_J)}}{\text{Max}} [\|Z\|] = \underset{\substack{Cons_1, \ldots, Cons_J \\ \in (Dom_C_1 x \ldots x Dom_C_J)}}{\text{Max}} \left[ \frac{1}{P} \sqrt{\sum_{p=1}^{P} \left| \sum_{j=1}^{J} (HB'_{pj} * B_j)(t) \right|^2} \right]$$

or implementing $$\underset{\substack{Cons_1, \ldots, Cons_J \\ \in (Dom_C_1 x \ldots x Dom_C_J)}}{\text{Max}} [\|Z+b\|^2] = \underset{\substack{Cons_1, \ldots, Cons_J \\ \in (Dom_C_1 x \ldots x Dom_C_J)}}{\text{Max}} \left[ \frac{1}{P} \sqrt{\sum_{p=1}^{P} \left| \sum_{j=1}^{J} (HB'_{pj} * B_j)(t) \right|^2 + \sum_{p=1}^{P} \left| \sum_{m=1}^{M} (H0'_{pm} * S_m)(t) \right|^2} \right]$$

and/or a BC2-type constraint relating to a minimum threshold for the average level on the target points $Ci_p$ for the jamming or "jamming+useful residual" signal $$(Cons_1, \ldots, Cons_J) \in (\text{Dom_C}_1 \ x \ldots x\text{Dom_C}_J)$$

$$t.q. \ \frac{1}{P}\sqrt{\sum_{p=1}^{P}|Z_p|^2} = \frac{1}{P}\sqrt{\sum_{p=1}^{P}\left|\sum_{j=1}^{J}(HB'_{pj} * B_j)(t)\right|^2} \geq \text{Av_eff_BC_threshold}$$

or $$t.q. \ \frac{1}{P}\sqrt{\sum_{p=1}^{P}|Z_P + b_p|^2} = \frac{1}{P}\sqrt{\sum_{p=1}^{P}\left|\sum_{j=1}^{J}(HB'_{pj} * B_j)(t)\right|^2 + \sum_{p=1}^{P}\left|\sum_{m=1}^{M}(H0'_{pm} * S_m)(t)\right|^2} \geq \text{Av_eff_BC_threshold}$$

and/or a BC3-type constraint relating to a minimum threshold for the jamming signal level or the "jamming+useful residual" signal at each target point $Ci_p$:

$$(Cons_1, \ldots, Cons_J) \in (\text{Dom_C}_1 \ x \ldots x\text{Dom_C}_J)$$

$$t.q. \ \underset{p=1,\ldots P}{\text{Min}}[|Z_p|] = \underset{p=1,\ldots,P}{\text{Min}}\sqrt{\left|\sum_{j=1}^{J}(HB'_{pj} * B_i)(t)\right|^2} \geq \text{Min_eff_BC_threshold}$$

or $$t.q. \ \underset{p=1,\ldots P}{\text{Min}}[|Z_p + b_p|] = \underset{p=1,\ldots P}{\text{Min}}\sqrt{\left|\sum_{j=1}^{J}(HB'_{pj} * B_j)(t) + \sum_{m=1}^{M}(H0'_{pm} * S_m)(t)\right|^2} \geq \text{Min_eff_BC_threshold}$$

etc.

(ii) At least one "constraint J linked to the reduction in the interference on the receivers, which can be written in several forms on the basis of the above, such as the following forms, revealing convex functionals:

a J1-type constraint relating to the minimization of the average fratricidal or average fratricidal+interfering signal level of the receivers $Rx_n$:

$$(Cons_1, \ldots, Cons_J) \in (\text{Dom_C}_1 \ x \ldots x\text{Dom_C}_J)$$

implementing $$\underset{\substack{(Cons_1,\ldots,Cons_J)\\ \in(Dom_C_1 x \ldots xDom_C_J)}}{\text{Min}}[\|J\|] = \underset{\substack{(Cons_1,\ldots,Cons_J)\\ \in(Dom_C_1 x \ldots xDom_C_J)}}{\text{Min}}\left[\frac{1}{N}\sqrt{\sum_{n=1}^{N}\left|\sum_{j=1}^{J}(HJ'_{nj} * B_j)(t)\right|^2}\right]$$

or implementing $$\underset{\substack{(Cons_1,\ldots,Cons_J)\\ \in(Dom_C_1 x \ldots xDom_C_J)}}{\text{Min}}[\|I\|] = \underset{\substack{(Cons_1,\ldots,Cons_J)\\ \in(Dom_C_1 x \ldots xDom_C_J)}}{\text{Min}}\left[\frac{1}{N}\sqrt{\sum_{n=1}^{N}\left|\sum_{m=1}^{M}(H0'_{nm} * S_m)(t)\right|^2 + \sum_{n=1}^{N}\left|\sum_{j=1}^{J}(HJ'_{nj} * B_j)(t)\right|^2}\right]$$

and/or a J2-type constraint relating to maximum thresholding for the average fratricidal or fratricidal+interfering signal level on each receiver $Rx_n$:

$$(Cons_1, \ldots, Cons_J) \in (\text{Dom_C}_1 \; x \ldots x\text{Dom_C}_J)$$
$$t.q. \quad \frac{1}{N}\sqrt{\sum_{n=1}^{N}|J_n|^2} = \frac{1}{N}\sqrt{\sum_{n=1}^{N}\left|\sum_{j=1}^{J}(HJ'_{nj} * B_j)(t)\right|^2} \leq \text{Av_J_Rx_threshold}$$

or $$t.q. \quad \frac{1}{N}\sqrt{\sum_{n=1}^{N}|I_n|^2} = \frac{1}{N}\sqrt{\begin{array}{l}\sum_{n=1}^{N}\left|\sum_{m=1}^{M}(H0'_{nm} * S_m)(t)\right|^2 + \\ \sum_{n=1}^{N}\left|\sum_{j=1}^{J}(HJ'_{nj} * B_j)(t)\right|^2\end{array}} \leq \text{Av_J_Rx_threshold}$$

and/or a J3-type constraint relating to maximum thresholding for the interfering signal level on each receiver $Rx_n$:

$$(Cons_1, \ldots, Cons_J) \in (\text{Dom_C}_1 \; x \ldots x\text{Dom_C}_J)$$
$$t.q. \quad \underset{n=1,\ldots N}{\text{Max}}[|J_n|] = \underset{n=1,\ldots N}{\text{Max}}\left[\frac{1}{N}\sqrt{\left|\sum_{j=1}^{J}(HJ'_{nj} * B_j)(t)\right|^2}\right] \leq \text{Max_J_Rx_threshold}$$

or $$t.q. \quad \underset{n=1,\ldots N}{\text{Max}}[|I_n|] = \underset{n=1,\ldots N}{\text{Max}}\left[\frac{1}{N}\sqrt{\begin{array}{l}\sum_{n=1}^{N}\left|\sum_{m=1}^{M}(H0'_{nm} * S)(t)\right|^2 + \\ \sum_{n=1}^{N}\left|\sum_{j=1}^{J}(HJ'_{nj} * B_j)(t)\right|^2\end{array}}\right] \leq \text{Max_J_Rx_threshold}$$

etc.

(iii) If need be a MinJ instruction linked to the minimization of the transmitted jamming power, which can be written in several forms on the basis of the above, such as the following forms, revealing convex functionals:

A MinJ1-type instruction: minimizing the average jamming power over the course of time t and on the jammers j $$(Cons_1, \ldots, Cons_J) \in (\text{Dom_C}_1 \; x \ldots x\text{Dom_C}_J)$$
$$\text{Min}\left\{\sqrt{\cdot\frac{1}{J}\sum_{j=1}^{J}\langle|B_j(t)|^2\rangle_t}\right\}$$

and/or a MinJ2-type instruction: minimizing the maximum power averaged over time, transmitted by each jammer j $$(Cons_1, \ldots, Cons_J) \in (\text{Dom_C}_1 \; x \ldots x\text{Dom_C}_J)$$
$$\text{Min}\left\{\underset{j}{\text{Max}}(\langle|B_j(t)|^2\rangle_t)\right\}$$

and/or a MinJ3-type instruction: minimizing the instantaneous power transmitted by each jammer j $$(Cons_1, \ldots, Cons_J) \in (\text{Dom_C}_1 \; x \ldots x\text{Dom_C}_J)$$
$$\text{Min}\left\{\underset{j,t}{\text{Max}}(|B_j(t)|^2)\right\}$$

etc.

Example 1

Cooperative Barrage Jamming

This particular implementation example for the invention applies to the optimization of tactical barrage jamming in the presence of friendly frequency-hopping communication stations, a method which was the subject of the patent from the applicant under the number EP 1303069.

The text below shows how the general method of the invention described previously can be used for this particular application.

The master station manages a barrage jammer or a network of barrage jammers that are capable of interrupting, upon instruction, their transmissions on a time slot and on a frequency channel indicated by an instruction.

P tactical stations that are present in the theatre need to be jammed, denoted by $Ci_p$, p=1, . . . , P. These stations are positions which are known or otherwise. The services that they use and the corresponding points of operation are supposed to be known, as are their features (jamming thresholds/denial of various services, operating margins, etc.).

N friendly frequency-hopping tactical receivers need to be preserved, denoted by $R_n$ n=1, . . . , N.

These receivers are positions that are known approximately. Their waveform and their modes of operation are known features of the master station of the jammers:

The frequency-hopping law, and, if need be, the transmission powers and waveforms used, are known a priori, or even guided by a tactical communication node.

The tactical communication node informs the master station of the jammers, a station which thus knows the following a priori:

the risks of interference caused on the receivers to be preserved, the time slots and the frequency channels occupied at each instant by the frequency-hopping stages.

In consideration of a time/frequency framework for the useful transmissions which is defined by:

all of the frequency channels (and of the associated bands) in the frequency map of the tactical network, numbered from $F_1$ to $F_V$, the time frame for the frequency-hopping transmissions is defined by the guard time, the rising and falling fronts of the stages, the stage duration, the period of recurrence, and a number $T_s$ of slots in which the stages are transmitted per period of recurrence.

The temporal process can be indexed on the frame by applying the method according to the invention on a frame-by-frame basis. The k-th frame will be denoted by $t_k$. For each frame, it is thus a matter for the master station and the jammer(s):

to leave the time/frequency slots on which the useful communication frequency-hopping stages are transmitted and received empty of any jamming signal, to transmit a jamming signal on all of the other time-frequency slots.

The propagation times for the signals over several tens of kilometers at the most are negligible in the face of the durations of the useful stages. Similarly, Doppler shifts are negligible in the face of the bands of the useful transmissions. The physical problem is thus reduced to determining the instances at which the transmissions start and the channels that correspond to these transmissions.

The theoretical optimization problem to be solved for this precise implementation example for the invention is thus highly simplified:

The admissible domain is discrete and defined by:

all of the frequency channels $F_1$ to $F_V$, all of the slots $T_1$ to $T_S$ of the frame $t_k$, two power values transmitted by the jammer(s): 0 (no transmission) or P (transmission).

For each frame $t_k$, each jammer thus indicates the slots (indexed by $1<s_{1,k}, s_{2,k}, s_{k1,k}<5$) and the frequencies (indexed by $1<\nu_{1,k}, \nu_{2,k}, \nu_{k2,k}<S$) to be left empty of a jamming signal (i.e. apply instruction P=0).

Direct Deterministic Solution to the Optimization Problem

If the jammer is ideal and is able to exactly position its "jamming holes" on the useful slots without overflowing onto adjacent frequencies or onto adjacent slots, the optimization problem is solved directly because there is no fratricidal effect on the useful stations if the following instruction is complied with perfectly: for each frame $t_k$, apply to the jammer the no-transmission instruction for each "useful" slot $(s_{ksk}, \nu_{k\nu k})$.

Case of a Single Jammer with a Fault+Consideration of the Attenuation of Propagation by Using Return Channels This implementation example for the invention extends directly to the consideration of the imperfections in the jammers and the attenuation due to the propagation of the jammer in the direction of the useful:

Fall and rise times of the jamming signal causing a minimum jamming duration $t_{Br}$ greater than the slot duration, which reduces the effectiveness of the barrage jamming all the more, Overflow of the jamming hole spectrum onto adjacent frequencies, which is modelled by an equivalent band $B_{Br}$ which must be higher than the band of the stage in order to guarantee the absence of the fratricidal effect, which reduces the effectiveness of the barrage jamming all the more, Balance of the link between the jammer and the useful receiver $R_n$ that are modelled by a coefficient of loss $L_n$ causing a level at the input $L_nP$. This input level can be measured by the useful receivers and indicated by return channel to the master, which accordingly adapts the instructions to the jammer, Operating threshold of the useful receivers for $L_nP<\Delta$.

There again, the optimization problem is solved in a highly simplified fashion because there is no fratricidal effect on the useful stations if the following instruction is complied with perfectly: for each frame $t_k$, apply to the jammer the no-transmission instruction for each "useful" slot $(s_{ksk}, \nu_{k\nu k})$ for which $L_nP<\Delta$.

Case of Several Jammers in a Network with Faults+Consideration of the Attenuation of Propagation by Using Return Channels The implementation example for the invention extends directly to the consideration of multiple jammers with imperfections and with attenuations due to the differing propagation conditions of the jammers in the direction of the useful.

Fall and rise times of the jamming signal causing a minimum jamming duration $t_{Br}$ greater than the slot duration, which reduces the effectiveness of the barrage jamming all the more Overflow of the jamming hole spectrum onto adjacent frequencies, which is modelled by an equivalent band $BW_{Br}$ which must be higher than the band of the stage in order to guarantee the absence of fratricidal effect, which reduces the effectiveness of the barrage jamming all the more:

Balance of the link between the jammer $Br_j$ and the useful receiver $R_n$ which are modelled by a coefficient of loss $L_{j,n}$ causing a level at the input $L_{j,n}P$. N.B.: this input level can be measured by the useful receivers and indicated by return channel to the master, which accordingly adapts the instructions to the jammer Operating threshold of the useful receivers for $L_{j,n}P<\Delta$.

There again, the optimization problem is solved in a highly simplified fashion because there is no fratricidal effect on the useful stations if the following instruction is complied with perfectly:

For each jammer $B_j$, for each frame $t_k$, apply to the jammer the no-transmission instruction for each "useful" slot $(s_{ksk}, \nu_{k\nu k})$ for which $L_{j,n}P<\Delta$ Example 2

GNSS Jamming

This particular implementation example for the invention applies to the optimization of multiservice GNSS jamming, described in the patent application FR09/05346 entitled "method and system for jamming GNSS signals". The text below shows how the general method of the invention described previously can be used for this particular application.

It is noted that, since GNSS signals are essentially continuous in nature, there is no time dependency in the application of the method since the environment continues to be static.

The following is considered:

a fixed jamming device made up of J jammers $B_j$ indexed by j=1, . . . , J, of given maximum powers. The jammers are in positions and orientations which are known. Each GNSS service supported by a useful signal s has an associated dedicated jamming waveform (FOB) denoted by $B_{j,s}(t)$. Each jammer can be parameterized to transmit one or more FOB at different respective average powers $C_{j,s}=<|B_{j,s}(t)|^2>_t$. If these waveforms are decorrelated, each jammer thus has a transmitted total average power $C_j=<|B_j(t)|^2>_t$ which is written as j=1, . . . , J; $C_j=\Sigma_{s=1 \ldots, s} C_{j,s}$.

P GNSS receivers need to be jammed, which are denoted by $C_p$ p=1, . . . , P. These receivers are in known positions. The GNSS services that they use are supposed to be known, as are their features (jamming thresholds/denial of various services, operating margins, etc.).

$GE_{j,n}$: the antenna gain of the jammer j in the direction of the receiver n (dBi), the corresponding equivalent radiated isotropic power can be written as $PIRE_j=C_s\ GE_{j,n}$ $D_{j,n}$: the directivity of the reception antenna n in the direction of the jammer j (dBi)

$SSC_{j,s}$: the coefficient of spectral correlation between the jammer signal $B_j(t)$ and the useful signal s(t) (with a value between 0 and 1)

$C_{j,s}$: the average power of the signal transmitted by the jammer j for the denial of service supported by the signal s signal (dBm) (i.e. level of power allocated by the jammer j to the FOB dedicated to the service s) $C_{j,s}=<|B_{j,s}(t)|^2>_t$ $C_j$: the average total power of the signal transmitted by the jammer j (dBm): $C_j=<|B_j(t)|^2>_t$:

$L_{j,n}$: the propagation loss between the jammer j and the receiver n (dB).

With the previous formalism, the problem is thus modelled in the form of instructions on the jammers Bj needing to comply with the constraints of effectiveness of the jamming on the targets $C_p$ p=1, . . . , P, and the constraints of absence of fratricidal denial on receivers $R_n$ n=1, . . . , N; while minimizing the average total power of jamming:

$$(Cons_1, \ldots, Cons_J) \in (\mathrm{Dom_C}_1 \times \ldots \times \mathrm{Dom_C}_J)$$

*t.q.*

$$\underset{p=1,\ldots,P}{\mathrm{Min}}[|z_p|] = \underset{p=1,\ldots,P}{\mathrm{Min}}\sqrt{\left|\sum_{j=1}^{J}(HB'_{pj} * B_i)(t)\right|^2} \geq \mathrm{Min_eff_Bc_threshold} \qquad (\text{constraint of type}(BC3))$$

$$\underset{n=1,\ldots,N}{\mathrm{Max}}[|J_n|] = \underset{n=1,\ldots,N}{\mathrm{Max}}\left[\frac{1}{N}\sqrt{\left|\sum_{j=1}^{J}(HJ'_{nj} * B_j)(t)\right|^2}\right] \leq \mathrm{Max_J_Rx_threshold} \qquad (\text{constraint of type}(J3))$$

$$\min_{\{J_{k,s}\}}\left(\sum_{j=1}^{J}\sum_{s=1}^{S} C_{j,s}\right) \qquad (\text{instruction of type}(\mathrm{Min}J1))$$

N GNSS receivers to be preserved, which are denoted by $R_n$ n=1, . . . , N. These receivers are in known positions and have known features. In this sense, the master station of the jammers has a priori information about the interference caused on the receivers to be preserved as if there were a return channel.

A linear interference model for the service s of each receiver n that is well known to a person skilled in the art (and, in order to simplify denotations, subsequently supposed to be homogeneous for each receiver, which does not cause any loss of generality for the invention):

$$\mathrm{SINR}_{n,j,s} = \frac{GR_s \cdot C_s / \eta_R}{N_{th} \cdot F_R + C_{j,s} \cdot Ge_{j,n} \cdot L_{j,n} \cdot D_{n,i} \cdot SSC_{j,s}}$$

with:

$C_s$: the power of the useful signal in front of the antenna for the service supported by the signal s (dBm)

$GR_s$: the gain obtained by the processing and by the reception antenna or the reception antenna network on the useful signal (dBi)

$\eta_R$: the yield internal to the reception chain (antenna yield, cable losses, etc.)

$F_R \cdot N_{th}$: the thermal noise of the receiver taking account of the noise factor $F_R$ of the reception chain The impulse responses HB' and HJ' are not known precisely but the associated channels can be modelled by an attenuation A that is estimated on the basis of the propagation models.

The use of the multisource interference model and of the antenna diagrams, by contrast, allows more precise clarification of the constraints of effectiveness and of absence of fratricidal denial:

For each receiver p=1, . . . , P to be jammed, for each service $s_p$=1, . . . , S used by the receiver p:

$$\sum_{j=1}^{J}\sum_{s_p=1}^{S} GE_{j,p} \cdot C_{j,s_p} \cdot L_{j,p} \cdot D_{j,p} \cdot SSC_{s_j,s_p} \geq \Delta'_{s_p}$$

$$\forall\, p = 1, \ldots, P$$

and $$\forall\, s_p = 1, \ldots, S$$

where $\Delta'_{s_p}$ is the guaranteed non-operation threshold of the receivers for the service $S_p$ For each receiver n=P+1, . . . , P+N to be preserved, for each service $s_n$=1, . . . , S used by the receiver n:

$$\sum_{j=1}^{J}\sum_{s_n=1}^{S} GE_{j,n}\cdot C_{j,s_n}\cdot D_{j,n}\cdot L_{j,n}\cdot SSC_{s_j,s_n} \le \Delta_{s_n}$$

$$\forall\, n = P+1, \ldots, P+N$$

and $$\forall\, s_n = 1, \ldots, S$$

where $\Delta s_n$ is the guaranteed operating threshold of the receivers for the service $S_n$ For each jammer j:

$$\sum_{s=1}^{S} C_{j,s} \le C_{Jimax}$$

$$\forall\, j = 1, \ldots, J$$

Given S GNSS services, J jammers, N protected receivers and P target receivers, there are N1+M1+J constraints:

P1 jamming constraints (P1<=P×S)

N1 non-jamming constraints (N1<=N×S)

J power constraints.

Using the denotations clarified below, the multiservice optimization problem is written in the following matrix form:

Max $C^t$.x

Under the constraints:

A.x=b x≥0

Denotations:

C is defined by:

$$C = \begin{bmatrix} [-1] \\ [0] \end{bmatrix}$$

[−1] vector of components −1 of dimension JxS

[0] null vector of dimension N1+M1+J x is defined by $$x = \begin{bmatrix} CJ \\ E \end{bmatrix}$$

vector of dimension J.S+(N1+M1+J) with the following arrangement: I=j,s: j=1, . . . J and for each j: s=1, . . . , S with $$CJ = \begin{bmatrix} C_1 \\ \vdots \\ C_J \end{bmatrix} = \begin{bmatrix} \begin{bmatrix} C_{1,1} \\ \vdots \\ C_{1,s} \end{bmatrix} \\ \vdots \\ \begin{bmatrix} C_{J,1} \\ \vdots \\ C_{J,s} \end{bmatrix} \end{bmatrix};$$

vector of dimension J×S, with $$E = \begin{bmatrix} \vdots \\ e_n \\ \vdots \end{bmatrix}$$

vector of dimension N1+M1+J where $e_n$ is a free variable representing the operating margin on the receiver n (difference between the operating threshold of the receiver and the global interference level).

$$A = \left[\begin{bmatrix} -A_a \\ A_b \\ Q \end{bmatrix} \begin{bmatrix} I_{N1} & 0 & 0 \\ 0 & I_{M1} & 0 \\ 0 & 0 & I_J \end{bmatrix}\right]$$

of dimension (N1+M1+J)×(J.S+N1+M1+J)

$I_{N1}$ identity matrix of size N1

$I_{M1}$ identity matrix of size M1

$I_J$ identity matrix of size J $$A_a = \begin{bmatrix} & \vdots & \\ \ldots & \alpha_{p,l} & \ldots \\ & \vdots & \end{bmatrix}$$

$$a_{p,l}\cdot GE_{j,p}\cdot D_{j,p}\cdot SSC_{s,sp}\cdot L_{j,np}$$

$$(p = 1, \ldots, P\cdot S;\ l = (j, s) = 1, \ldots, J\times S)$$

$$A_\beta = \begin{bmatrix} & \vdots & \\ \ldots & \beta_{n,l} & \ldots \\ & \vdots & \end{bmatrix}$$

$$\beta_{n,l}\cdot GE_{j,n}\cdot D_{j,n}, SSC_{s,sn}\cdot L_{j,n}$$

$$(n = P\cdot S+1, \ldots, (P+N)\cdot S;\ l = (j, s) = 1 \ldots J\times S)$$

$$Q = \begin{bmatrix} & \vdots & \\ \ldots & q_{n,k} & \ldots \\ & \vdots & \end{bmatrix}$$

$$q_{n,k} = 1 \text{ for } k = (n-1)\cdot S+1, \ldots, n\cdot S;$$

$q_{n,k}$=0 otherwise b is defined by $$b = \begin{bmatrix} -D_\alpha \\ D_\beta \\ CJ\max \end{bmatrix}$$

vector of dimension N1+M1+K with:

$$D_\alpha = \begin{bmatrix} \vdots \\ \Delta'_p \\ \vdots \end{bmatrix}$$

vector of dimension N1, p=1 . . . N1

$$D_\beta = \begin{bmatrix} \vdots \\ \Delta_n \\ \vdots \end{bmatrix}$$

vector of dimension M1, n=N1+1 . . . (N1+M1)

$$CJ_{max} = \begin{bmatrix} \vdots \\ CJ_{k_{max}} \\ \vdots \end{bmatrix}$$

vector of dimension J

The optimization problem posed above that corresponds to the implementation of the invention in this particular example is linear. The solution is thus obtained by implementing the simplex algorithm, which is well known to a person skilled in the art, for solving linear programming problems: given a set of linear inequalities over n real variables, the algorithm allows the optimum solution to be found for an objective function which is also linear.

In geometric terms, all of the linear inequalities define a polytope in n-dimensional space.

The simplex solution makes it possible to determine whether the problem has solutions and, if this is the case (for example for a convex polytope), to determine an extremum, that is to say a minimum-power jamming solution.

The invention claimed is:

1. A method for selectively and dynamically optimizing, with reduced fratricidal effects, the jamming of P predefined areas or positions in a network of communication transmitters, jammers and receivers comprising a plurality N_pl of platforms, a number M≤N_pl of said platforms being equipped with antennas and systems for transmitting useful transmission signals, a number N≤N_pl of said platforms being equipped with antennas and systems for receiving useful transmission signals, a number J≤N_pl of said platforms that are managed by a master station (1) being equipped with jamming systems and antennas suitable for preventing the transmissions between entities that are external to said network, comprising at least the following steps:

measuring the useful communication signals received by all of the N reception platforms, taking these measurements as a basis for estimating M*N useful propagation channels, and transmitting these measurements to the master station managing the platforms equipped with the jamming antennas, measuring all of the jamming signals received by the N reception platforms, taking these measurements as a basis for estimating J*N fratricidal propagation channels, and transmitting these measurements to said master station, taking the measurements of the useful communication signals and propagation channels and of the jamming propagation signals and channels as a basis for calculating, in the master station, jamming instruction values, the jamming signals, the recurrence of the transmissions, the carrier frequencies for the transmissions, the leads/delays upon transmission in relation to a synchronization reference, the radiated equivalent powers, the amplitude and phase weightings on the transmitting antenna networks and on the jamming antennas, guaranteeing an effectiveness for the P areas to be jammed corresponding to the entities that are external to the network, while minimizing the fratricidal effects on the N reception platforms, transmitting these instructions to the J platforms equipped with a jamming antenna, taking the first calculated and applied instructions, while continuously making use of the measurements from the fratricidal propagation channels coming from the receiving platforms, as a basis for optimizing by means of iteration the jamming of the areas to be jammed while maintaining fratricidal jamming which is acceptable for the quality of the useful transmissions.

2. The method according to claim 1, the method using the measurement from the propagation channels coming from the N reception platforms in order to jointly optimize the jamming and quality of the useful transmissions on the transmitting platforms by adapting the transmission power levels, and/or the spatio-temporal coding schemes and/or the transmission protocols in the time/frequency domain of the jammers and the transmitters.

3. The method according to claim 1, wherein the master station used is one of the transmission network platforms which is associated with a component for calculating the instructions intended for the jammers.

4. The method according to claim 2, wherein the master station used is one of the transmission network platforms which is associated with a component for calculating the instructions intended for the jammers.

5. The method according to claim 1, the method using programmable jammers that are suitable for dynamically taking into account transmission instructions, on the power and/or on temporal parameters, the waveform, spatio-temporal coding, the amplitude-phase weighting.

6. The method according to claim 2, the method using programmable jammers that are suitable for dynamically taking into account transmission instructions, on the power and/or on temporal parameters, the waveform, spatio-temporal coding, the amplitude-phase weighting.

7. Use of the method according to claim 1 in transmission networks using the MIMO, MISO, SIMO or SISO protocol with a return channel from the receivers to the transmitters.

8. Use of the method according to claim 1 in a radio network in which the receivers are suitable for measuring channel values on the useful transmitters and on the jammers.

9. Use of the method according to claim 1 in a radio network in which the reception stations have antenna elements that are coupled to an interceptor taking the channel measurements on the useful transmitters and on the jammers.

* * * * *